United States Patent [19]

Precoul et al.

[11] Patent Number: 4,669,386

[45] Date of Patent: Jun. 2, 1987

[54] SPREADABLE TELESCOPIC HEAD FOR APPLIANCES, PROJECTILES, BOMBS OR MISSILES

[75] Inventors: Michel Precoul; Jean-Claude Francois, both of Paris, France

[73] Assignee: Societe d'Etudes, DeRealisations et d'Applications Techniques (S.E.R.A.T.), Paris, France

[21] Appl. No.: 759,284

[22] Filed: Jul. 26, 1985

[30] Foreign Application Priority Data

Jul. 26, 1984 [FR] France ..... 84 11875

[51] Int. Cl.[4] ..... F42B 1/02; F42B 25/08; F42B 25/16

[52] U.S. Cl. ..... 102/476; 102/386; 102/393; 102/397; 102/489

[58] Field of Search ..... 102/476, 382, 386, 393, 102/394, 397, 489, 216, 272

[56] References Cited

U.S. PATENT DOCUMENTS

| | | | |
|---|---|---|---|
| 3,710,716 | 1/1973 | Davis et al. | 102/397 |
| 3,804,020 | 4/1974 | Norton | 102/397 X |
| 3,855,933 | 12/1974 | Messineo | 102/476 |
| 3,946,672 | 3/1976 | Adams et al. | 102/476 X |
| 4,433,626 | 2/1984 | Landström | 102/390 |

*Primary Examiner*—Deborah L. Kyle
*Assistant Examiner*—Ted L. Parr
*Attorney, Agent, or Firm*—Wenderoth, Lind & Ponack

[57] ABSTRACT

A telescopic warhead for a submunition ejectable from a carrier projectile the explosive charge of which is made up of submunitions scatterable and housed in the front portion of the carrier projectile, characterized in that the telescopic head includes a telescopic sliding skirt formed of a plurality of cylindrical elements, which are preferably metallic. The telescopic warhead, during storage, does not reduce the inside space requirement of the carrier projectile which leaves the inner volume available in front of the explosive charge whether the telescopic warhead is in a storage configuration or in an expanded configuration.

8 Claims, 11 Drawing Figures

FIG. IA
PRIOR ART

SPREADABLE TELESCOPIC HEAD FOR APPLIANCES, PROJECTILES, BOMBS OR MISSILES

BACKGROUND OF THE INVENTION

1. Field of the Invention

The present invention relates to improvements in telescopic warheads or noses for carrier projectiles such as appliances, bombs or missiles, the explosive charge of which is notably made of submunitions scatterable and housed in the front portion of said carrier projectiles.

2. Description of the Prior Art

Nowadays, there exist many embodiments of ammunitions, rockets and missiles, the explosive charge of which is made of submunitions which are contained inside an envelope, shell or container and which are scattered above the ground before detonation of the projectile carrying the charge.

To improve efficiency, the trend for the construction of such charges is to increase the number of submunitions carried in the same pay-load. However, this pursuit leads to reducing the space requirement of each of the submunitions and when the submunitions are stacked or nested along their axis into each other in the form of rows, the submunitions are short. As a result, there is a lower efficiency for hollow charges as well as for anti-personnel splinters or fragments.

Indeed, it is known that the best efficiency of a charge with splinter effects, operating by detonation on impact with the ground, is obtained by raising up the point of explosion above the ground, by lengthening the warhead of the projectile or of what is used as a warhead.

Likewise, the best efficiency in the case of a shaped charge is obtained by increasing the "stand-off distance" D (see FIG. 1) which is the length between the base of the liner "B" and the front portion or edge of the warhead "O". In fact, it is well known that it is possible to improve and even to optimize the perforating power P of a shaped charge by optimizing the stand-off distance. The increase in perforating power which can be obtained in this way is at first approximately proportional to the stand-off distance D, expressed in calibers, between 0 and 3 calibers, and is maximum for a stand-off distance D of about 4 to 6 calibers, as shown in the graph of FIG. 1A.

As such, spreadable devices have been proposed for lengthening the warhead, or what is used for it, of such ammunitions, with a view towards improving the performance of the charges, which carry an explosive having a shaped charge effect.

The spreadable devices proposed to date, such as the axially spreadable antennae for example, are housed in the warhead when stored, thus occupying for the main part, during storage prior to the spreading of the spreadable devices, the space formed by the inner volume of the warhead as such and that of the liner, which is usually left free.

But in some particular cases, such arrangements which are generally without disadvantages can be unacceptable and impracticable. Such is the case for the submunition charges with splinter effects, hollow charge effects or mixed effects previously mentioned, in which submunitions are nested into each other with the front volume of each submunition housing generally the rear portion (stabilizer, fuze, etc.) of the previous submunition, which thereby excludes axial antennae.

SUMMARY OF THE INVENTION

The present invention provides a telescopic warhead which is expandable or spreadable at the moment of scattering of the submunitions or upon the opening of an ammunition stabilizer, and the telescopic head is self-locking once it has been expanded.

The device according to the present invention has features, advantages and characteristics which allow improvement in the hollow charge effects and/or splinter effects of the charge on which it is adapted, without modifying the storing space requirement of said charge. Thus, a given container or carrier projectile comprises the same number of submunitions, each of which have a spreadable warhead according to the invention and thus are individually more efficient.

The telescopic warhead according to the invention is characterized in that it consists of a telescopic sliding skirt formed of at least one cylindrical element, preferably metallic, which does not modify, during storage, the outer space requirement of the missile, and which leaves free, during storage as well as in a spreaded configuration, the inner volume available in front of the explosive charge.

Thus, a spreadable warhead according to the invention, in addition to the advantages associated with lengthening of said warhead which it brings about (that is, raising the center of explosion above the ground at the moment of the impact or an increase in the "stand-off distance" of a hollow charge) is adaptable on submunitions while allowing the stacking and the axial nesting of said submunitions inside each other without increasing the space requirement, and notably the height of the columns of stacked submunitions, nor decreasing the number of rows of said submunitions.

BRIEF DESCRIPTION OF THE DRAWING

The various features and advantages of the invention will become more apparent from the following description of the preferred embodiments, with reference to the accompanying drawings, in which:

FIG. 1A shows the relationship between the stand-off distance D and the perforating power P of a shaped charge;

DETAILED DESCRIPTION OF THE PREFERRED EMBODIMENTS

Figure 1:
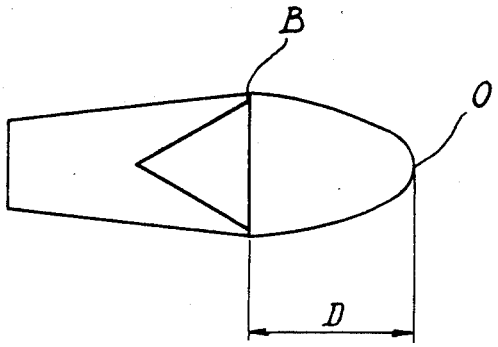
FIG. 1 PRIOR ART
FIG. 1 shows a conventional shaped charge.
Figure 1:
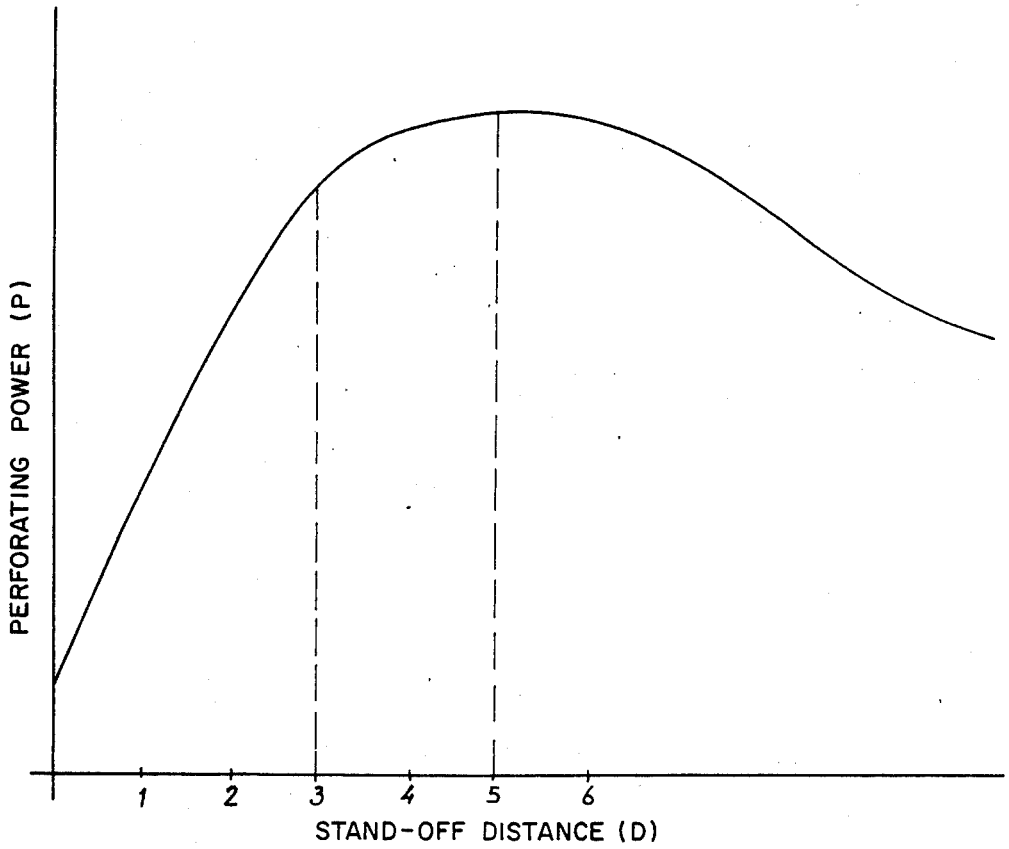
FIG. 1 PRIOR ART
Figure 2:
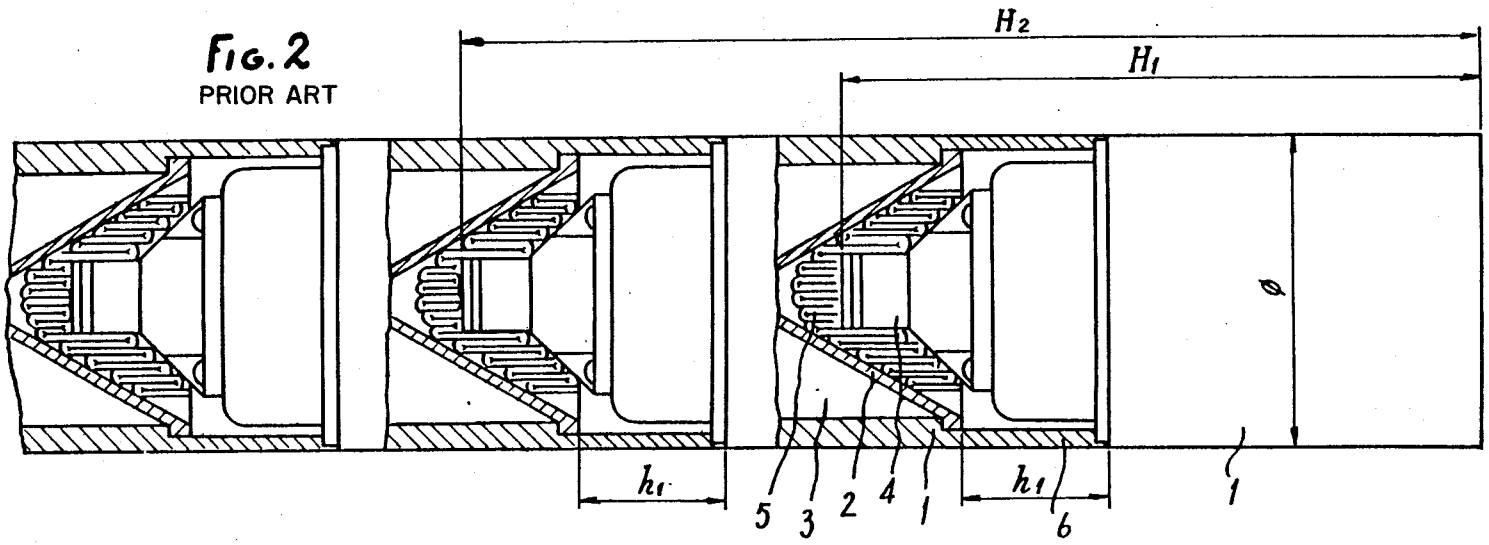
FIG. 2 PRIOR ART
FIG. 2 is a longitudinal sectional view of a conventional stacked submunition without the spreadable warhead according to the invention.
Figure 6:
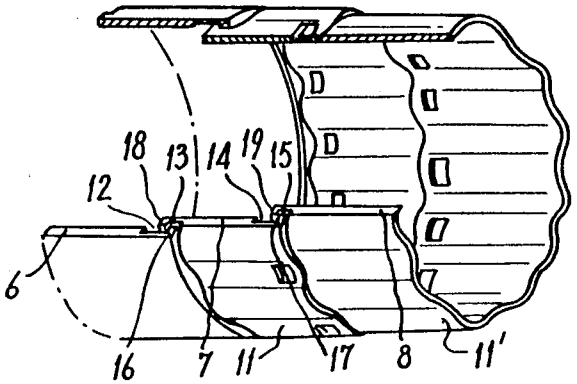
FIG. 6 is an exploded perspective view of the warhead according to the first embodiment of the invention in a "spreaded" configuration.
Figure 4:
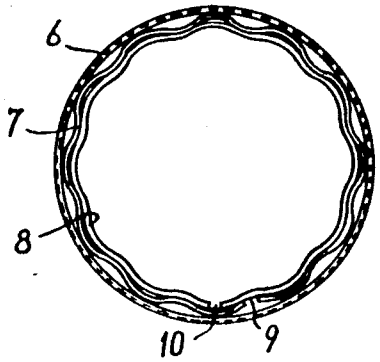
FIG. 4 shows a cross-sectional view along line FF of FIG. 3, with the warhead according to the invention in a "storage" configuration.
Figure 3:
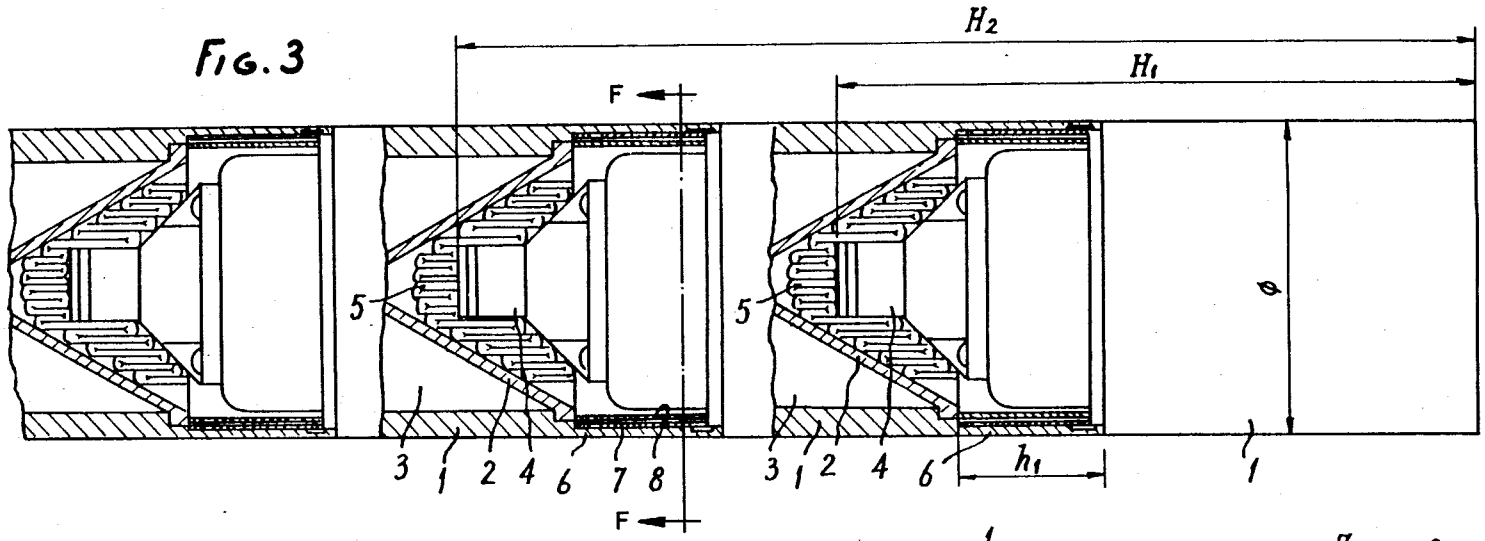
FIG. 3, which relates to the first embodiment of the present invention, shows a sectional view of submunitions with a telescopic warhead in their "storage" configuration, the submunitions shown being stacked and nested into each other, as they are for example in a charge with multiple submunitions.
Figure 5:
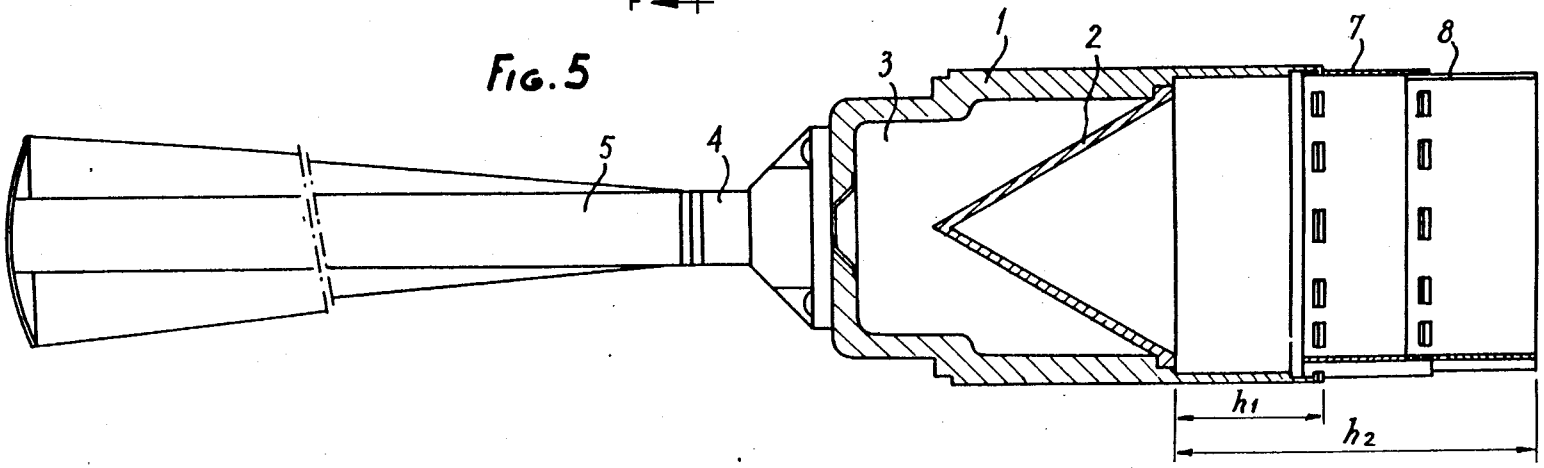
FIG. 5 shows a longitudinal sectional view of the submunition fitted out with the device of the first embodiment of the invention in a spreaded configuration.
Figure 7:
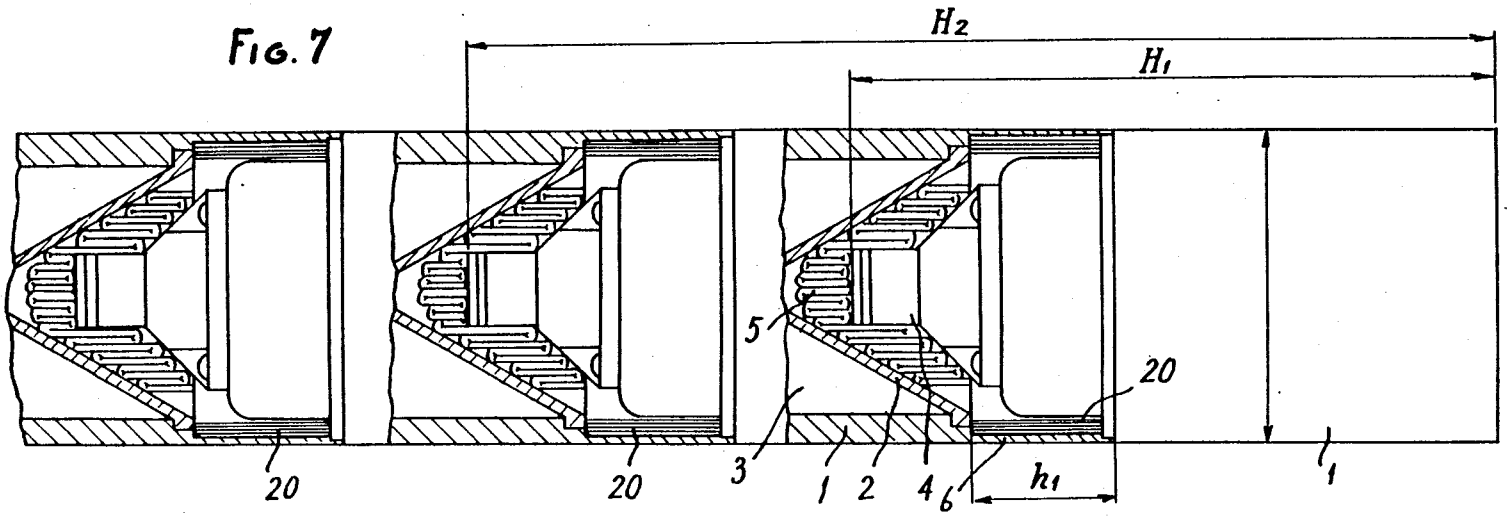
FIG. 7 is a longitudinal sectional view showing submunitions, fitted out with a telescopic warhead according to a second embodiment of the invention in a "storage" configuration, the submunitions shown being stacked and nested into each other, as they are in the completed charge ("mother" (carrier) projectile or container)
Figure 8:
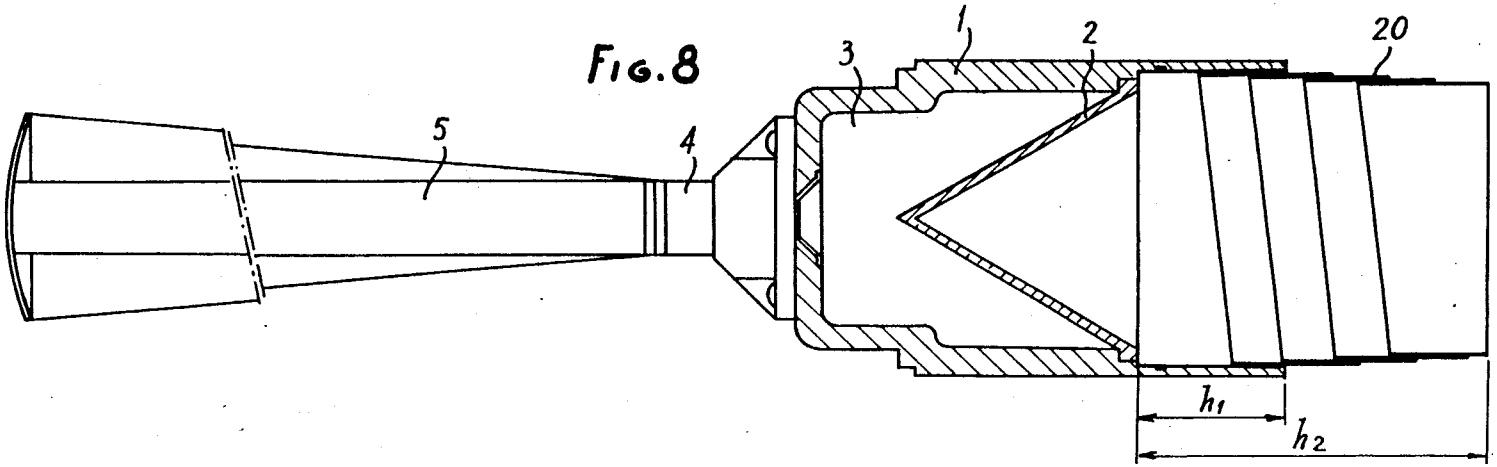
FIG. 8 is a longitudinal sectional view showing a submunition fitted out with the telescopic warhead according to the second embodiment of the invention in a "spreaded" configuration.
Figure 9:
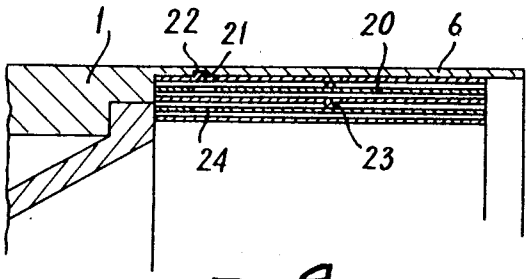
FIG. 9 and 10 are longitudinal sectional views in a larger scale of the warhead according to the second embodiment of the invention in a "storage" configuration in FIG. 9 and in a "spreaded" configuration in FIG. 10.
Figure 10:
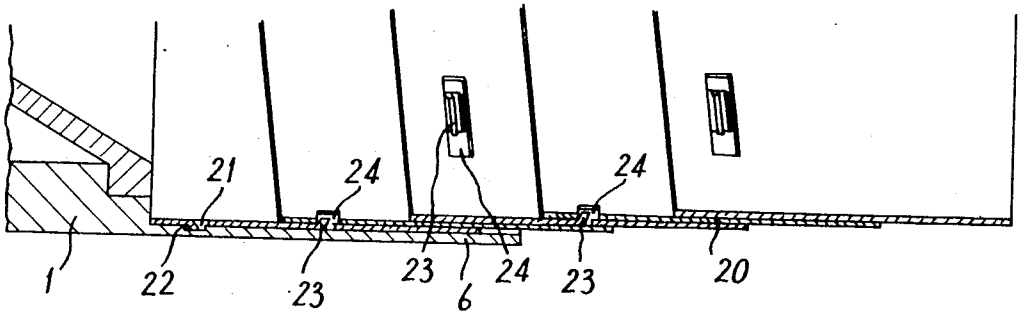

In the case of the construction according to the invention, shown in FIGS. 3 and 4, not only does the submunition fitted out with a warhead according to the invention in the storage condition need the same space requirement as the conventional submunition which is not equipped with the device (as shown in FIGS. 2 and 3, each have the same caliber $\phi$ and same overall height H1), but the space requirement with stacking of several submunitions into each other, in a "storage38 configuration, is also unchanged (thus for example for two submunitions, the conventional head shown in FIG. 2 and the head according to the present invention each have the same overall height H2).

On the other hand, after spreading of the warhead along a trajectory of a projectile to which the warhead is attached, the height h of the front skirt, which one can assume to be the stand-off distance D, changes from the value of h1, without the device, to a value of h2, with the device of the invention, therefore with a gain according to the ratio of about $h1/h2=2.5$ for the two embodiments of the present invention. Of course, this ratio of 2.5 is in no way a maximum limit but rather can be changed according to the construction of the ammunition on which the submunitions fitted out with the spreadable warhead according to the invention are adapted.

The device according to the invention, in the two proposed embodiments, is more especially adapted for a submunition with mixed effects (splinter effects and hollow charge effects) but it is obvious that said device can also be adapted, without departing from the scope of the invention, on any other type of submunition, ammunition or projectile, bomb, shell, container, etc.

In the two embodiments described, the submunition on which the spreadable warhead according to the invention is adapted is comprised of a charge body or case 1, a hollow charge liner 2, a load of explosive 3, a percussion fuze 4, placed in the rear portion of body 1, said fuze 4 being equipped with a flexible stabilizer 5. Body 1 includes in its front portion a skirt 6 of height h1. The skirt of each submunition, the front portion of which is nested in the rear cylindrical portion of the body of the previous submunition, allows for stacking and alignment of the submunitions, in the main mother charge of the container. The skirt 6 also provides upon impact of the submunition, in the case in which the skirt is not fitted out with the spreadable device according to the invention, a stand-off distance or an elevation above the ground which is indispensable but very small, and therefore incompatible with a good performance of the submunition.

In the first embodiment, the telescopic warhead according to the invention includes two sliding expansive, coaxial or concentrical, telescopic skirts or cylindrical sliding crowns, for example an outer skirt 7 and an inner skirt 8, which are disposed in the inner bore of skirt 6 of the body 1.

The two skirts 7 and 8 according to the invention are formed of a crown of thin metal plate, preferably steel, or of any other rigid material, split or separated by a gap along the axial length thereof at 9 and 10, respectively, imparting resiliency or elasticity in the radial direction to each of the two crowns or skirts according to the invention.

Longitudinally extending corrugations, respectively 11 and 11' of said skirts, according to the invention, impart to the latter a better resistance to crushing under an axial or longitudinal load (such as, percussion upon impact).

The skirts 7 and 8 according to the invention, are constructed such that the diameter of each is over-calibrated or larger than the diameter of the bore of skirt 6. Thus, upon assembly of the skirts 7 and 8 in a submunition the outer skirt 7 is compressed in the bore of skirt 6 of the body 1, and the inner skirt 8 is compressed inside the outer skirt 7. Under such conditions, during the mounting operations in the factory, the two skirts according to the invention are kept one inside the other in a foldaway configuration and in the front bore of the submunition by the friction generated between abutting surfaces due to the force of expansion acting on the two skirts.

The thickness of the walls of the skirts can be small (about 0.1 mm for example), which results in a correspondingly low amount of friction between the skirts. Depending on the appropriate setting of the elements involved, the sliding of skirts 7 and 8, with respect to each other and in the bore of the fixed skirt 6 of body 1, can be performed under small longitudinal efforts which can be for example generated by the interia of the sliding skirts 7 and 8 during ejection of the submunitions from the main charge and at the moment of the opening of stabilizer 5.

Locking means, such as grooves and flanges on the skirt 6, 7 and 8 are provided in order to limit the sliding of skirts 7 and 8 with respect to body 1 of the submunition on the one hand, and between themselves on the other hand, in order to latch the device in a "spreaded" or "expanded" configuration at the end of the spreading using the expansive capacities of skirts 7 and 8.

To achieve this object according to the invention, the front portion of body 1 includes an inner groove 12 extending circumferentially in the bore of the skirt 6 at a small distance from the front edge of the skirt 6. Opposite said groove, the rear portion of the outer skirt 7 includes an outer groove 13 extending circumferentially in only the radially outermost corrugations 11 of the skirt 7 at a distance conveniently chosen from its rear edge.

Likewise, the front portion of the outer skirt 7 includes an inner groove 14 extending circumferentially in only the radially innermost corrugations 11 of the skirt 7 at a small distance from its front edge. Opposite the latter, the rear portion of the inner skirt 8 includes an outer groove 15 extending circumferentially in only the radially outermost corrugations 11' at a distance conveniently chosen from its rear edge. The provision of the inner and outer grooves 12–15 results in the formation, in the front portions of the skirt 6 and the outer skirt 7, of inner flanges 16 and 17 respectively, and at the rear portion of skirts 7 and 8, of outer flanges 18 and 19 respectively.

The flanges thus formed constitute abutments for the end of the longitudinal sliding motion and of the radial expansion of skirts 7 and 8, and provide therefore, according to the invention, a limitation for the longitudinal spreading of the skirts and a latching or locking of said skirts in the "spreaded" or "expanded" configuration.

The dynamics of the operation of the first embodiment of the device according to the invention can be summarized as follows:

Under the effect of the interia acting on the sliding skirts 7 and 8 at the moment of the ejection of the submunition or of the opening of its stabilizer 5, the skirts slide frontwardly together in a direction away from the body of the submunition.

At the end of the spreading, on the one hand, groove 13 of skirt 7 comes in contact with flange 16 of body 1, and thus flange 18 of skirt 7 latches or locks with groove 12 of body 1, and on the other hand but not necessarily at the same time, flange 19 of skirt 8 comes in contact with groove 14 of skirt 7 and groove 15 of skirt 8 latches or locks with flange 17 of skirt 7. The skirts, which were initially radially compressed, according to one of the features of the invention, then expand radially, with each respective flange coming into engagement with a respective groove.

Under such conditions, the longitudinal sliding motion of the skirts in a direction away from body 1 is stopped, the lateral forward edges of the flanges coming into abutment with the lateral rearward edges of the grooves. Thus, the device of the invention is latched or locked in a "spreaded" configuration.

Likewise, at the moment of the impact of the submunition, the sliding motion of the skirts to the rear is made impossible, the lateral edges oriented to the rear of the flanges coming in abutment against the side edges oriented to the front of the grooves. The device is thus latched in a "spreaded" configuration, thereby guaranteeing the desired lengthening of the head, or stand-off distance.

In the second embodiment, the telescopic warhead according to the invention is made of a "flat" convoluted helical spring 20, housed in the inside bore of skirt 6 of the body 1.

Spring 20 is an involuted "flat" helical spring including any number of turns, such as five turns in the non limiting example given here. In the absence of any compressive forces, the free spring expands to a spreaded or axially expanded condition.

To maintain the spring 20 inside the skirt 6, the skirt 6 includes an inner groove 21 extending circumferentially in the rear portion of the bore of skirt 6. Opposite said groove, the outer turn of spring 20 (last turn in the wound state) includes a series of studs 22 protruding radially outwardly at positions which correspond with the groove 21. Said studs 22 are provided preferably by a direct cutting and forming operation on a steel strip forming the "flat" spring 20.

For setting skirt 6 in place in body 1, the spring 20 is radially compressed, in order to have its outer turn engaging inside the bore of skirt 6.

When the outer turn abuts the bottom of the bore of skirt 6, the studs 22 are in register with the groove 21 and due to the resiliency or expandability of springs 20, the studs 22 engage inside groove 21, immobilizing longitudinally the outer turn of the spring 20 and maintaining the spring 20 rigidly connected to body 1 of the submunition.

When the submunition are stacked onto each other (e.g. when assembled in the main charge), spring 20 of each of them is axially compressed by bearing against the rear edge of the cylindrical portion of body 1 of the preceding submunition and, in the axially compressed state, does not project beyond the front edge of skirt 6 of the body of the submunition on which it is placed.

At the moment of ejection of the submunition from the main charge, the submunitions are disconnected from each other and the spring 20 of each expands axially towards the front of and away from the respective body 1.

To limit the spreading or expanding of spring 20 and above all to latch or lock the spring in a "spreaded" or "expanded" configuration, the steel strip forming spring 20 comprises a series of studs 23 distributed over the entire length thereof and protruding radially inwardly, the projecting portion being inclined in the direction of travel of the spring 20. The studs 23 are provided in the steel strip forming the spring 20 by a direct cutting and forming operation in the same manner as studs 22 are formed. On the other hand, the steel strip is also formed with openings 24, which are the same in number as studs 23, and which are distributed as the latter over the entire length of the spring 20.

The openings 24 are cut out in the steel strip in positions such that, when the spring is expanded, the openings engage the corresponding studs 23. Under such conditions, due to the resiliency and thus radial expansion of spring 20, the studs 23 come in engagement inside the openings 24, immobilizing longitudinally the turns of spring 20 between them, and thereby providing the latching or locking of the device according to the invention in a "spreaded" or "expanded" configuration.

It is stressed that the device according to the invention is not only limited to the adaptation on submunitions but rather, without departing from the scope of the invention, it applies to any projectile, shell, bomb, and notably to explosive missiles for which a reduced space requirement is desired for storage, transportation and at the moment of firing, but for which the lengthening of the warhead is desirable, for example for improving the charge efficiency, but also for any other reason such as for example the adaptation of the ballistic characteristics.

On the other hand, any other modes of construction, shapes, proportions, dispositions, etc., can also be used without departing from the scope of the invention.

Obviously, the invention is in no way limited to the embodiments shown and described, and said embodiments can be modified in various manners within the scope of the accompanying claims.

We claim:

1. A telescopic warhead stand-off for submunitions ejectable from a carrier projectile, the explosive charge of which comprises scatterable submunitions disposed in a front portion of the carrier projectile, each submunition comprising a charge case, a hollow charge liner disposed within the charge case, an explosive disposed between the charge liner and the charge case, a fuze disposed at a rear portion of the charge case, a flexible stabilizer disposed rearwardly of the fuze and a skirt disposed forwardly of the hollow charge liner, wherein the improvement comprises, a telescopic skirt disposed in a bore of the skirt of the charge case, said telescopic skirt comprising cylindrical crowns each of which is slidable outwardly of the bore of the skirt of the charge case to an expanded condition under the effect of inertial forces exerted on said crowns during ejection of the submunition from the carrier projectile and during opening of the stabilizer of the submunition.

2. The telescopic warhead stand-off of claim 1, wherein each of said crowns is separated by a gap along the axial length thereof to impart to said crowns a radial elasticity enabling said crowns to be compressed radially for mounting thereof in the bore of the skirt and maintaining said crowns in a foldaway configuration due to friction between said crowns and the skirt of the charge case, each of said crowns also being corrugated with the corrugations extending parallel to the axial length of said crowns whereby the axial rigidity of said crowns is increased and said crowns are more resistant to crushing along the axial length thereof.

3. The telescopic warhead stand-off of claim 1, further comprising means for locking said crowns when said crowns are in said expanded condition, said locking means comprising circumferentially extending inner grooves on inner surfaces of the skirt of the charge case and on said crowns adjacent axial ends thereof facing away from the charge case and circumferentially extending outer grooves on outer surfaces of said crowns adjacent axial ends thereof facing the charge case, each of said outer grooves being separated from the axial end of a respective one of said crowns by a flange which is received in a corresponding one of said inner grooves and each of said inner grooves being separated from the axial end of a respective one of the skirt of the charge case and said crowns by a flange which is received in a corresponding one of said outer grooves when said crowns are in said expanded condition.

4. A telescopic warhead stand-off for submunitions which are scatterable by ejection from a carrier projectile, the explosive charge of which comprises a plurality of said scatterable submunitions disposed in a front portion of said carrier projectile, each of said submunitions copmrising a charge case, a hollow charge liner disposed within said charge case, an explosive disposed between said charge liner and said charge case, a fuze disposed at a rear portion of said charge case, a flexible stabilizer disposed rearwardly of said fuze and a skirt having an axially extending bore disposed forwardly of said hollow charge liner, and a plurality of telescoping coaxial cylindrical crowns slidably disposed in said bore of said skirt, each of said crowns being slidable in an axial direction outwardly of said bore in said skirt to an expanded condition under the effect of inertial forces exerted on said crowns during ejection of said submunition from said carrier projectile and during opening of said stabilizer of said submunition.

5. A telescopic warhead stand-off of claim 4, wherein each of said crowns includes a gap extending along the entire axial length thereof whereby said crowns can be radially compressed for mounting thereof in said bore of said skirt and maintaining said crowns in a foldaway configuration due to friction therebetween and friction between one of said crowns in sliding contact with said bore of said skirt.

6. The telescopic warhead stand-off of claim 4, wherein each of said crowns is corrugated with the corrugations extending parallel to said axial direction to thereby increase the rigidity of said crowns and improve the resistance to crushing of said crowns in said axial direction.

7. The telescopic warhead stand-off of claim 6, further comprising means for locking said crowns when said crowns are in said expanded condition, said locking means comprising circumferentially extending inner grooves on the inner surface of said skirt and on radially innermost surfaces of the corrugations of said crowns adjacent axial ends thereof facing away from said charge case and circumferentially extending outer grooves on radially outermost surfaces of the corrugations of said crowns adjacent axial ends thereof facing said charge case, each of said outer grooves being separated from the axial end of a respective one of said crowns by a flange which is received in a corresponding one of said inner grooves and each of said inner grooves being separated from the axial end of a respective one of said skirt and said crowns by a flange which is received in a corresponding one of said outer grooves when said crowns are in said expanded condition.

8. The telescopic warhead stand-off of claim 4, further comprising means for locking said crowns when said crowns are in said expanded condition, said locking means comprising circumferentially extending inner grooves on inner surfaces of said skirt and said crowns adjacent axial ends thereof facing away from said charge case and circumferentially extending outer grooves on outer surfaces of said crowns adjacent axial ends thereof facing said charge case, each of said outer grooves being separated from the axial end of a respective one of said crowns by a flange which is received in a corresponding one of said inner grooves and each of said inner grooves being separated from the axial end of a respective one of said skirt and said crowns by a flange which is received in a corresponding one of said outer grooves when said crowns are in said expanded condition.

* * * * *